US008104948B2

(12) United States Patent
Satake

(10) Patent No.: US 8,104,948 B2
(45) Date of Patent: Jan. 31, 2012

(54) PROCESSING LIQUID MIXING APPARATUS AND METHOD, SUBSTRATE PROCESSING APPARATUS, AND STORAGE MEDIUM

(75) Inventor: Keigo Satake, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 588 days.

(21) Appl. No.: 12/357,083

(22) Filed: Jan. 21, 2009

(65) Prior Publication Data

US 2009/0188565 A1 Jul. 30, 2009

(30) Foreign Application Priority Data

Jan. 21, 2008 (JP) ..... 2008-010950

(51) Int. Cl.
*B01F 15/04* (2006.01)

(52) U.S. Cl. ..... 366/151.1; 137/606; 137/897; 366/152.1; 700/285

(58) Field of Classification Search ..... 366/136, 366/137, 151.1, 152.1, 152.2; 137/606, 897; 700/285

See application file for complete search history.

(56) References Cited

U.S. PATENT DOCUMENTS

| | | | | |
|---|---|---|---|---|
| 2,979,066 | A * | 4/1961 | Christie | 137/3 |
| 4,403,866 | A * | 9/1983 | Falcoff et al. | 366/132 |
| 4,823,987 | A * | 4/1989 | Switall | 137/391 |
| 5,409,310 | A * | 4/1995 | Owczarz | 366/136 |
| 6,494,608 | B1 * | 12/2002 | Retamal et al. | 366/132 |
| 2005/0099883 | A1 * | 5/2005 | Choi | 366/152.2 |

FOREIGN PATENT DOCUMENTS

JP 2003-275569 9/2003

* cited by examiner

*Primary Examiner* — Robert B Davis
(74) *Attorney, Agent, or Firm* — Harry K. Ahn; Abelman Frayne & Schwab

(57) ABSTRACT

A processing liquid mixing apparatus and method capable of maintaining a mixing ratio of the processing liquid produced in a mixing tank constant, a substrate processing apparatus including the processing liquid mixing apparatus, and a storage medium storing a program for controlling the processing liquid mixing apparatus are disclosed. Discharge valves are first open and supply valves are close to discharge stock solutions to an outside through the discharge valves. After all flow rates of the stock solutions detected by LFC reach a predetermined flow rate, the discharge valves are close and the supply valves are open to supply the stock solutions to the second mixing tank through the supply valves.

13 Claims, 5 Drawing Sheets

PROCESSING LIQUID MIXING APPARATUS AND METHOD, SUBSTRATE PROCESSING APPARATUS, AND STORAGE MEDIUM

This application is based on and claims priority from Japanese Patent Application No. 2008-010950, filed on Jan. 21, 2008 in the Japanese Patent Office, the disclosure of which is incorporated herein in its entirety by reference.

TECHNICAL FIELD

The present invention relates to a processing liquid mixing apparatus and method for mixing processing liquid, capable of producing the processing liquid by mixing a plurality of stock solutions in a predetermined ratio, a storage medium that stores a processing liquid mixing program, and a substrate processing apparatus provided with the processing liquid mixing apparatus.

BACKGROUND

Manufacturing processes of semiconductor devices or liquid crystal panels include liquid processing processes, such as cleaning or etching. Liquid processing processes include applying processing liquid to target objects or dipping target objects into processing liquid. Processing liquid can be produced by mixing stock solutions in a predetermined ratio. Various processing liquid can be used in liquid processing processes. Processing liquid for used in a cleaning process, for example, is shown in Table 1 below.

TABLE 1

| Name | Mixing Ratio | Use |
|---|---|---|
| Mixture of Ammonia Water and Hydrogen Peroxide Solution | $NH_4OH:H_2O_2:H_2O$ = 1:1:5 (Volume Ratio) | Remove Particles<br>Remove Organic Acid |
| Mixture of Hydrochloric Acid and Hydrogen Peroxide Solution | $HCl:H_2O_2:H_2O$ = 1:1:5 (Volume Ratio) | Remove Metallic Pollutants |
| Mixture of Sulfuric Acid and Hydrogen Peroxide Solution | $H_2SO_4:H_2O_2$ = 4:1 (Volume Ratio) | Remove Organic Pollutants<br>Remove Metallic Pollutants |
| Hydrofluoric Acid | HF (about 0.5-10%) | Remove Si (Natural) Oxide Layer<br>Remove Metallic Pollutants (Remove Cu) |
| Buffered Hydrofluoric Acid Solution | $HF:NH_4F$ = 7:1 | Remove Si (Natural) Oxide Layer |

Plants may require dedicated pipes for each processing liquid when producing various processing liquid and supplying the produced processing liquid to each substrate processing apparatus. As a result, a plant will have a complicated inner structure, which will not be practical. Accordingly, plants include pipes to supply stock solutions for producing processing liquid to each substrate processing apparatus. Also, each substrate processing apparatus includes processing liquid mixing apparatuses to produce processing liquid.

Some processing liquid mixing apparatuses have been suggested in order to have constant mixing ratio of stock solutions in processing liquid. For example, Japanese patent unexamined publication no. 2003-275569 discloses a processing liquid mixing apparatus, including mixing tanks to mix various stock solutions, a flow controller to control an amount of the stock solutions, and a supply time controller to control supply time of each stock solution to the mixing tanks so that each stock solution can be supplied to the mixing tanks at the same time.

However, the processing liquid mixing apparatus disclosed in the Japanese patent unexamined publication no. 2003-275569 cannot control a supply rate of each stock solution to the mixing tanks, while it can control a total amount (that is, an accumulated flow rate) of each stock solution supplied to the mixing tanks and the supply time of each stock solution to the mixing tanks.

Generally, the flow controller gradually increases the flow rates of stock solutions supplied to the mixing tanks after the discharge of the stock solutions starts, and maintains the discharge rates of the stock solutions constant if the flow rates of the stock solutions reach a predetermined value. The time for increasing the flow rates of the stock solutions to the predetermined value after the discharge of the stock solutions starts is in proportion to set flow rates.

Accordingly, the processing liquid mixing apparatus disclosed in the Japanese patent unexamined publication no. 2003-275569 cannot make the flow rate proportions of stock solutions supplied to the mixing tanks to be coincided with the mixing ratio of the processing liquid at certain supply time. In particular, at an initial supply time, the stock solution having a relatively high set flow rate cannot reach the set flow rate while the stock solution having a relatively low set flow rate can reach the set flow rate. Thus, an amount of the stock solution having the relatively low set flow rate becomes greater.

SUMMARY

The present invention provides a processing liquid mixing apparatus and method for mixing processing liquid, capable of maintaining a mixing ratio of the processing liquid produced in a mixing tank constant, a substrate processing apparatus provided with the processing liquid mixing apparatus, and a storage medium that stores a program to control the processing liquid mixing tank.

According to one example, a processing liquid mixing apparatus is provided. The apparatus includes a mixing tank to mix a plurality of stock solutions, a flow controller provided in supply flow paths to control flow rates of the stock solutions flowing through the supply flow paths at predetermined flow rates, the supply flow paths each supplying the stock solutions from stock solution supply sources to the mixing tank, a flow detector to detect the flow rates of the stock solutions flowing through the supply flow paths, discharge valves provided between the flow controller of the supply flow paths and the mixing tank to discharge the stock solutions flowing through the supply flow paths to an outside, supply valves provided between the discharge valves of the supply flow paths and the mixing tank to open/close the supply flow paths, and a controller to close the supply valves of the supply flow paths and to open the discharge valves of the supply flow paths when the supply of the stock solutions to the mixing tank starts, and to close the discharge valves of the supply flow paths and to open the supply valves of the supply flow paths after all the flow rates of the stock solutions detected by the flow detector reach the predetermined flow rates.

The controller may close the discharge valves and open the supply valves when all the flow rates detected by the flow detector reach the predetermined flow rates.

The controller may close the discharge valves and open the supply valves when all the flow rates detected by the flow detector reach the predetermined flow rates and a predetermined time elapses.

The controller may open the discharge valves for each stock solution with time differences according to the set flow rates of the flow controller and a time-flow rate characteristic.

The controller may open the discharge valves in the descending order of the set flow rates of the flow controller.

A substrate processing apparatus according to the present invention may be provided with the above-described processing liquid mixing apparatus.

According to another example, a method for mixing processing liquid using a processing liquid mixing apparatus is provided. The processing liquid mixing apparatus includes a mixing tank to mix a plurality of stock solutions, a flow controller provided in supply flow paths to control flow rates of the stock solutions flowing through the supply flow paths at predetermined flow rates, the supply flow paths each supplying the stock solutions from stock solution supply sources to the mixing tank, a flow detector to detect the flow rates of the stock solutions flowing through the supply flow paths, discharge valves provided between the flow controller of the supply flow paths and the mixing tank to discharge the stock solutions flowing through the supply flow paths to an outside, and supply valves provided between the discharge valves of the supply flow paths and the mixing tanks to open/close the supply flow paths. The method includes closing the supply valves of the supply flow paths and opening the discharge valves of the supply flow paths when the supply of the stock solutions to the mixing tank starts and closing the discharge valves of the supply flow paths and opening the supply valves of the supply flow paths after all the flow rates of the stock solutions detected by the flow detector reach the predetermined flow rates.

The method may further include closing the discharge valves and opening the supply valves when all the flow rates detected by the flow detector reach the predetermined flow rates.

The method may further include closing the discharge valves and opening the supply valves when all the flow rates detected by the flow detector reach the predetermined flow rates and a predetermined time elapses.

The method may further include opening the discharge valves for each stock to solution with time differences according to the set flow rates of the flow controller and a time-flow rate characteristic.

The method may further include opening the discharge valves in the descending order of the set flow rates of the flow controller.

According to still another example, a storage medium storing a program executed by a computer that controls a processing liquid mixing apparatus is provided. The processing liquid mixing apparatus includes a mixing tank to mix a plurality of stock solutions, a flow controller provided in supply flow paths to control flow rates of the stock solutions flowing through the supply flow paths at predetermined flow rates, the supply flow paths each supplying the stock solutions from stock solution supply sources to the mixing tank, a flow detector to detect the flow rates of the stock solutions flowing through the supply flow paths, discharge valves provided between the flow controller of the supply flow paths and the mixing tanks to discharge the stock solutions flowing through the supply flow paths to an outside, and supply valves provided between the discharge valves of the supply flow paths and the mixing tank to open/close the supply flow paths. The program includes closing the supply valves of the supply flow paths and opening the discharge valves of the supply flow paths when the supply of the stock solutions to the mixing tank starts and closing the discharge valves of the supply flow paths and opening the supply valves of the supply flow paths after all the flow rates of the stock solutions detected by the flow detector reach the predetermined flow rates.

According to the present invention, since the stock solutions are supplied to the mixing tank after all the flow rates of the stock solutions reach the predetermined flow rates, the processing liquid with a predetermined mixing ratio (i.e. density) is produced at an initial supply time of the stock solutions.

Also, by starting the discharge of the stock solutions with time differences according to the time-flow rate characteristics of the plural flow controller, the waiting time for supplying the stock solutions to the mixing tanks, until the flow rate of one stock solution reaches the predetermined flow rate after the flow rate of the other stock solution reaches the predetermined flow rate, can be reduced or is not required. Accordingly, the waste of a predetermined stock solution can be minimized.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
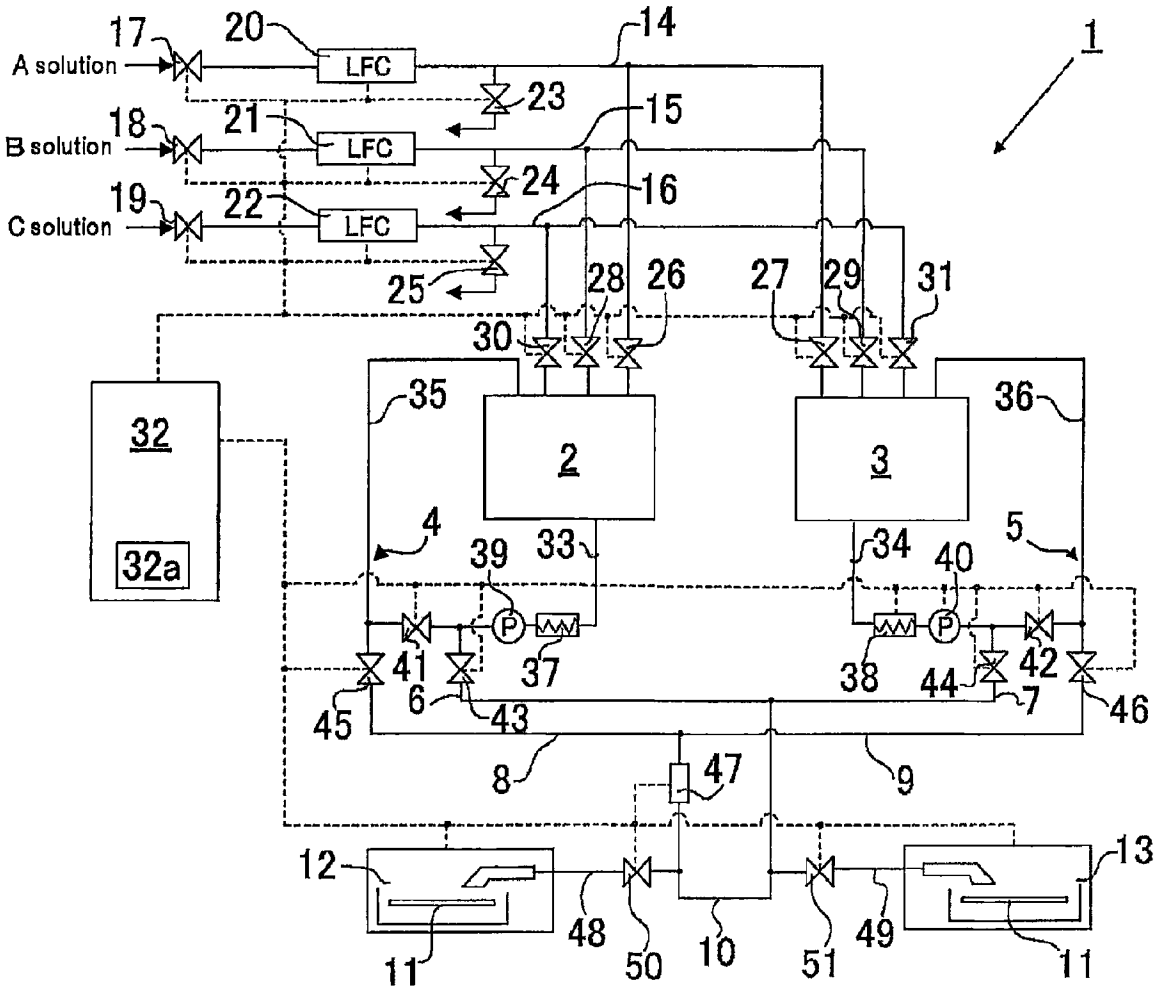
FIG. 1 is a conceptual view illustrating a substrate processing apparatus according to an embodiment of the present invention.

FIG. 1 is a conceptual view illustrating a substrate processing apparatus according to an embodiment of the present invention.

As illustrated in FIG. 1, a substrate processing apparatus 1 includes first and second mixing tanks 2 and 3 to produce processing liquid by mixing stock solutions A, B, and C, closed loop type reciprocating flow paths 4 and 5 communicated to the first and second mixing tanks 2 and 3, outflow paths 6 and 7 and inflow paths 8 and 9, the starting ends of the outflow paths 6 and 7 and the terminal ends of the inflow paths 8 and 9 communicated to the reciprocating flow paths 4 and 5, respectively. The substrate processing apparatus 1 further includes a common circulation flow path 10 communicated between the terminal ends of the outflow paths 6 and 7 and the starting ends of the inflow paths 8 and 9, and first and second chemical solution processing units 12 and 13 communicated to the circulation flow path 10 to process a target wafer 11 with processing liquid are communicated to the circulation flow path 10.

The substrate processing apparatus 1 still further includes A solution supply flow path 14, B solution supply flow path 15, and C solution supply flow path 16, each supplying the stock solutions A, B, and C from A, B, and C solution supply sources (not illustrated) to the first and second mixing tanks 2 and 3, communicated to the first and second mixing tanks 2 and 3, and delivery valves 17, 18, and 19 provided between the A, B, and C solution supply sources and the first and second mixing tanks 2 and 3 to start/stop the delivery of the stock solutions A, B, and C through the A, B, and C solution supply flow paths 14, 15, and 16.

The substrate processing apparatus 1 still further includes flow controllers (LFC) 20, 21, and 22, discharge valves 23, 24, and 25, supply valves 26 to 31 provided between the delivery valves 17, 18, and 19 of the A, B, and C solution supply flow paths 14, 15, and 16 and the first and second mixing tanks 2 and 3, and a control unit 32.

The LFC 20, 21, and 22 control the flow rates of the stock solutions A, B, and C such that the stock solutions A, B, and C flow through the A, B, and C solution supply flow paths 14, 15, and 16 at a flow rate set by the control unit 32 (i.e. set flow rate), detect the flow rates of the stock solutions A, B, and C flowing through the A, B, and C solution supply flow paths 14, 15, and 16, and feed the detected flow rates back to the control unit 32. That is, the LFC 20, 21, and 22 control the flow rates of the stock solutions, as well as detecting the flow rates of the stock solutions.

The control unit 32 controls the opening/closing of the discharge valves 23, 24, and 25 and the supply valves 26 to 31. If the discharge valves 23, 24, and 25 are open and the supply valves 26 to 31 are close, the stock solutions A, B, and C flowing through the A, B, and C solution supply flow paths 14, 15, and 16 are discharged to an outside. By contrast, if the discharge valves 23, 24, and 25 are closed and the supply valves 26 to 31 are open, the stock solutions A, B, and C flowing through the A, B, and C solution supply flow paths 14, 15, and 16 are supplied to the first and second mixing tanks 2 and 3. That is, by selecting the opening/closing of the discharge valves 23, 24, and 25 and the supply valves 26 to 31, the outflow points of the stock solutions A, B, and C flowing through the A, B, and C solution supply flow paths 14, 15, and 16 can be changed. Also, the opening/closing of the delivery valves 17, 18, and 19 can be controlled by the control unit 32.

The reciprocating flow paths 4 and 5 include going-side flow paths 33 and 34 and returning-side flow paths 35 and 36. At each of the going-side flow paths 33 and 34, a heater 37 or 38, a pump 39 or 40, and an opening/closing valve 41 or 42 are sequentially provided. The heaters 37 and 38, the pumps 39 and 40, and the opening/closing valves 41 and 42 are connected to the control unit 32, and their operation or opening/closing is controlled by the control unit 32.

The starting ends of the outflow paths 6 and 7 are connected between the pumps 39 and 40 and the opening/closing valves 41 and 42 of the going-side flow paths 33 and 34. The outflow paths 6 and 7 include opening/closing valves 43 and 44. The opening/closing valves 43 and 44 are connected to the control unit 32, and their opening/closing is controlled by the control unit 32.

Also, the terminal ends of the inflow paths 8 and 9 are connected to the returning-side flow paths 35 and 36, and the inflow paths 8 and 9 are provided with opening/closing valves 45 and 46. The opening/closing valves 45 and 46 are connected to the control unit 32, and their opening/closing is controlled by the control unit 32.

The terminal ends of the outflow paths 6 and 7 are connected to each other, and a starting end of the circulation flow path 10 is connected to the connection part of the terminal ends of the outflow paths 6 and 7. Also, the starting ends of the inflow paths 8 and 9 are connected to each other, and the terminal end of the circulation flow path 10 is connected to the connection part of the starting ends of the inflow paths 8 and 9. Accordingly, the circulation flow path 10 is commonly communicated to the first and second mixing tanks 2 and 3 through the reciprocating flow paths 4 and 5, the outflow paths 6 and 7, and the inflow paths 8 and 9.

At the terminal end of the circulation flow path 10, a density sensor 47 to detect the density of the processing liquid inside the substrate processing apparatus 1 is provided. The density sensor 47 is connected to the control unit 32.

Also, at an intermediate part of the circulation flow path 10, supply flow paths 48 and 49 of the first and second chemical solution processing unit 12 and 13 are connected. The supply flow paths 48 and 49 are provided with opening/closing valves 50 and 51. The opening/closing valves 50 and 51, and the first and second chemical solution processing unit 12 and 13 are connected to the control unit 32, and their opening/closing is controlled by the control unit 32.

The substrate processing apparatus 1 mixes and produces the processing liquid and supplies the processing liquid to the first and second chemical solution processing units 12 and 13 in accordance with a processing liquid supply program stored in a storage medium 32*a* (such as a memory, a bard disk, a disk type memory, and the like) installed in the control unit 32.

Figure 2:
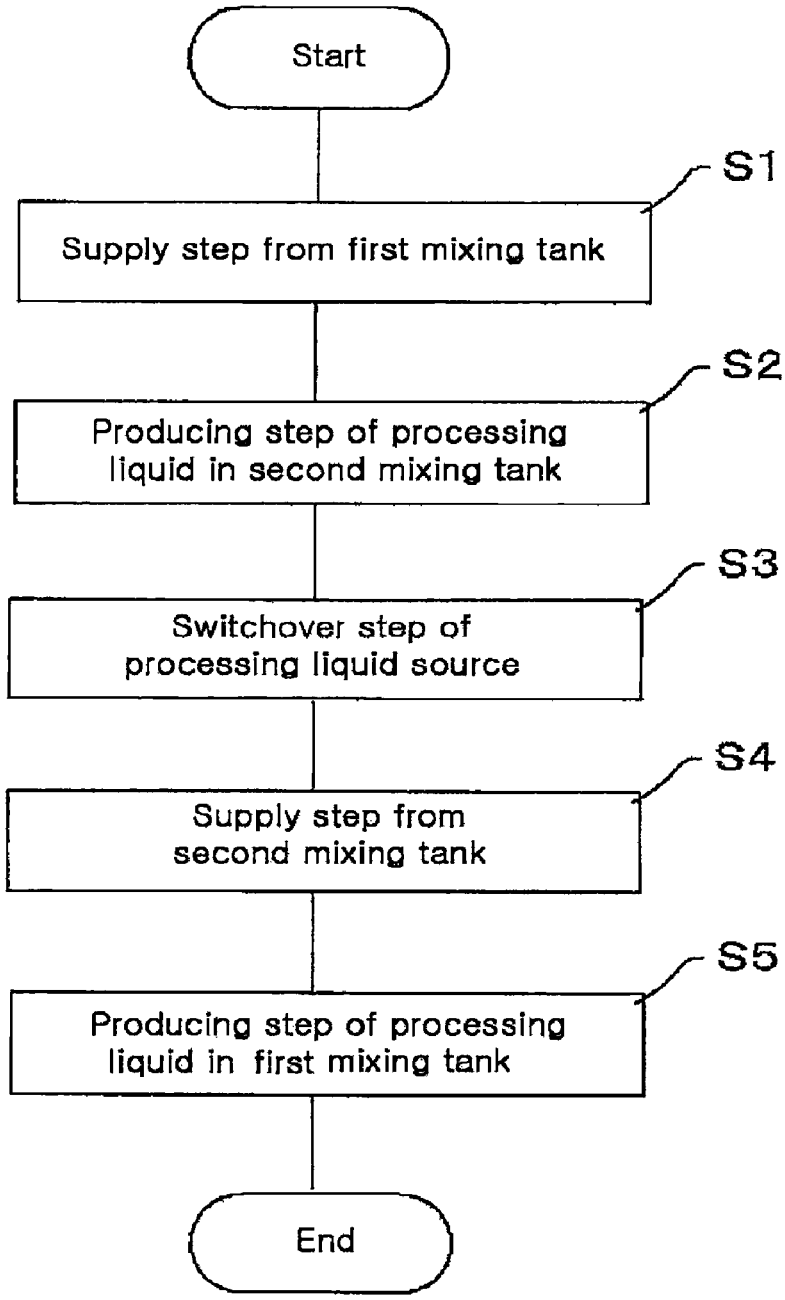
FIG. 2 is a flowchart illustrating the processing liquid supply of the substrate processing apparatus in accordance with a processing liquid supply program according to an embodiment of the present invention.

FIG. 2 is a flowchart illustrating the processing liquid supply of the substrate processing apparatus in accordance with a processing liquid supply program according to an embodiment of the present invention. Hereinafter, with reference to FIG. 2, the processing liquid supply of the substrate processing apparatus in accordance with the processing liquid supply program according to an embodiment of the present invention will be described.

The substrate processing apparatus 1 operates to alternately switch over between a state that the processing liquid is supplied from the first mixing tank 2 to the first and second chemical solution processing units 12 and 13 and a state that the processing liquid is supplied from the second mixing tank 3 to the first and second chemical solution processing units 12 and 13. For convenience in explanation, FIG. 2 shows, by way of examples, that the processing liquid is produced in the first mixing tank 2, and the switchover takes place from the state that the processing liquid is supplied from the first mixing tank 2 to the first and second chemical solution processing units 12 and 13 to the state that the processing liquid is supplied from the second mixing tank 3 to the first and second chemical solution processing units 12 and 13.

[Supply Step from First Mixing Tank (S1)]

According to the processing solution supply program, the processing liquid is supplied from the first mixing tank 2 to the first and second chemical processing units 12 and 13.

At this time, the control unit 32 drives the pump 39, makes the opening/closing valve 41 of the reciprocating flow path 4 in a closed state, makes the opening/closing valve 43 of the outflow path 6 and the opening/closing valve 45 of the inflow path 8 in an open state, and opens/closes the opening/closing valves 50 and 51 of the supply flow paths 48 and 49. Accordingly, the processing liquid is circulated in the order of the first mixing tank 2→the going-side flow path 33→the outflow path 6→the circulation flow path 10→the inflow path 8→the returning-side flow path 35→the first mixing tank 2. Thus, the processing liquid is supplied from the circulation flow path 10 to the first and second chemical solution processing units 12 and 13 through the supply flow paths 48 and 49.

[Producing Step of Processing Liquid in Second Mixing Tank (S2)]

While the processing liquid is supplied from the first mixing tank 2 to the first and second chemical solution processing units 12 and 13, the second mixing tank 3 produces the processing liquid by mixing the stock solutions A, B, and C in a predetermined ratio, and stirs the produced processing liquid at a regulated temperature.

First, the control unit 32 sets a predetermined flow rate, and makes the discharge valves 23, 24, and 25 in an open state and the supply valves 26 to 31 in a closed state. The stock solutions A, B, and C delivered from the delivery valves 17, 18, and 19 are discharged to an outside through the discharge valves 23, 24, and 25.

If the discharge valves 23, 24, and 25 are open, the flow rates of the stock solutions A, B, and C flowing through the A, B, and C solution supply flow paths 14, 15, and 16 gradually increase and reach the set flow rate. If the LFC 20, 21, and 22 detect that the flow rates of the stock solutions A, B, and C reach the set flow rate, the control unit 32 closes the discharge valves 23, 24, and 25, and simultaneously opens the supply valves 27, 29, and 31 to supply the stock solutions A, B, and C to the second mixing tank 3. Thereafter, the LFC 20, 21, and 22 continue controlling of the flow rates of the stock solutions A, B, and C so that the flow rates of the stock solutions A, B, and C maintain the set flow rate. If a predetermined amount of processing liquid is gathered in the second mixing tank 3, the control unit 32 stops the supply of the stock solutions A, B, and C to the second mixing tank 3 by closing the supply valves 27, 29, and 31. The sequence of opening/closing the discharge valves 23, 24, and 25 and the supply valves 27, 29, and 31 will be described later.

If the predetermined amount of processing liquid is gathered in the second mixing tank 3 and the supply of the stock solutions A, B, and C to the second mixing tank 3 is stopped, the control unit 32 drives the heater 38 and the pump 40, makes the opening/closing valve 44 of the outflow path 7 and the opening/closing valve 46 of the inflow path 9 in a closed state, and makes the opening/closing valve 42 of the reciprocating flow path 5 in an open state. Accordingly, the processing liquid is circulated in the order of the second mixing tank 3→the going-side flow path 34→the returning-side flow path 36→the second mixing tank 3, and the processing solution is stirred at a regulated temperature.

[Switchover Step of Processing liquid Source (S3)]

If an amount of the processing liquid in the first mixing tank 2 becomes insufficient, the supply source of the processing liquid is switched from the first mixing tank 2 to the second mixing tank 3.

At this time, the control unit 32 makes the opening/closing valve 41 of the going-side flow path 33 connected to the first mixing tank 2 and the opening/closing valve 43 of the outflow path 6 in a closed state, makes the opening/closing valve 42 of the going-side flow path 34 connected to the second mixing tank 3 in a closed state, and makes the opening/closing valve 46 of the inflow path 9 in an open state. Also, the control unit 32 makes the opening/closing valve 45 of the inflow path 8 in a closed state, and makes the opening/closing valve 44 of the outflow path 7 connected to the second mixing tank 3 in an open state. Accordingly, the processing solution is circulated in the order of the second mixing tank 3→the going-side flow path 34→the outflow path 7→the circulation flow path 10→the inflow path 9→the returning-side flow path 36→the second mixing tank 3.

[Supply Step from Second Mixing Tank (S4)]

Then, the processing liquid is supplied from the second mixing tank 3 to the first and second chemical solution processing units 12 and 13.

By opening/closing the opening/closing valves 50 and 51 of the supply flow paths 48 and 49, the processing liquid from the circulation flow path 10 is supplied to the first and second chemical solution processing units 12 and 13 through the supply flow paths 48 and 49.

[Producing Step of Processing Liquid in First Mixing Tank (S5)]

While the processing liquid is supplied from the second mixing tank 3 to the first and second chemical solution processing units 12 and 13, the first mixing tank 2 newly produces processing liquid, circulates the produced processing liquid through the reciprocating flow path 4, and stirs the produced processing liquid at a regulated temperature.

First, the control unit 32 makes the discharge valves 23, 24, and 215 in an open state. At this time, since the supply valves 26 to 31 are in a closed state, the stock solutions A, B, and C delivered from the delivery valves 17, 18, and 19 are discharged to an outside through the discharge valves 23, 24, and 25.

If the discharge valves 23, 24, and 25 are open, the flow rates of the stock solutions A, B, and C flowing through the A, B, and C solution supply flow paths 14, 15, and 16 gradually increase and reach the set flow rate. If the LFC 20, 21, and 22 detect that the flow rates of the stock solutions A, B, and C reach the set flow rate, the control unit 32 closes the discharge valves 23, 24, and 25, and simultaneously opens the supply valves 26, 28, and 30 to supply the stock solutions A, B, and C to the first mixing tank 2. Thereafter, the LFC 20, 21, and 22 continue controlling of the flow rates of the stock solutions A, B, and C so that the flow rates of the stock solutions A, B, and C maintain the set flow rate. If a predetermined amount of processing liquid is gathered in the first mixing tank 2, the control unit 32 stops the supply of the stock solutions A, B, and C to the first mixing tank 2 by closing the supply valves 26, 28, and 30. The detailed sequences of opening/closing the discharge valves 23, 24, and 25 and the supply valves 26, 28, and 30 are the same as those in producing step of processing liquid in the second mixing tank (S2).

If the predetermined amount of processing liquid is gathered in the first mixing tank 2 and the supply of the stock solutions A, B, and C to the first mixing tank 2 is stopped, the control unit 32 drives the heater 37 and the pump 39, makes the opening/closing valve 43 of the outflow path 6 and the opening/closing valve 45 of the inflow path 8 in a closed state, and makes the opening/closing valve 41 of the reciprocating flow path 4 in an open state. Accordingly, the processing liquid is circulated in the order of the first mixing tank 2→the going-side flow path 33→the returning-side flow path 35→the first mixing tank 2, and the processing liquid is stirred at a regulated temperature.

As described above, for convenience in explanation, the processing liquid supply is performed by producing the processing liquid in the second mixing tank 3 while the processing liquid in the first mixing tank 2 is supplied to the first and second chemical solution processing units 12 and 13, switching the supply source of the processing liquid from the first mixing tank 2 to the mixing tank 3, and producing the processing liquid in the first mixing tank 2 while the processing liquid in the second mixing tank 3 is supplied to the chemical solution processing units 12 and 13 again. In the case of continuously operating the substrate processing apparatus 1, the supply source of the processing liquid is switched from the first mixing tank 2 to the second mixing tank 3, and then the processing liquid is repeatedly produced in the second mixing tank 3 while the processing liquid in the first mixing tank 2 is supplied to the chemical solution processing units 12 and 13. That is, by alternately using the first mixing tank 2 and the second mixing tank 3, the processing liquid in one mixing tank is produced while the processing liquid in the other mixing tank is supplied to the chemical solution processing units 12 and 13.

Before examples of the detailed manipulation sequence of each valve in producing step of processing liquid in the second mixing tank (S2) is described, assume that a precondition for determining the manipulation sequence is as follows.

<1> The processing liquid used in the substrate processing apparatus 1 is produced by mixing the stock solutions A, B, and C in the volume ratio of 3:6:8.

<2> In order to mix the stock solutions A, B, and C in the above-described ratio, the stock solutions A, B, and C in the ratio of 12:24:32 liters per minute are supplied to the first and second mixing tanks 2 and 3.

<3> It takes about 5 seconds to reach the delivery ratio of 12 liters per minute after the start of the delivery of the stock solution A. It takes about 20 seconds to reach the delivery ratio of 24 liters per minute after the start of the delivery of the stock solution B. It takes about 20 seconds to reach the delivery ratio of 32 liters per minute and is stabilized after the start of the delivery of the stock solution C.

Figure 3:
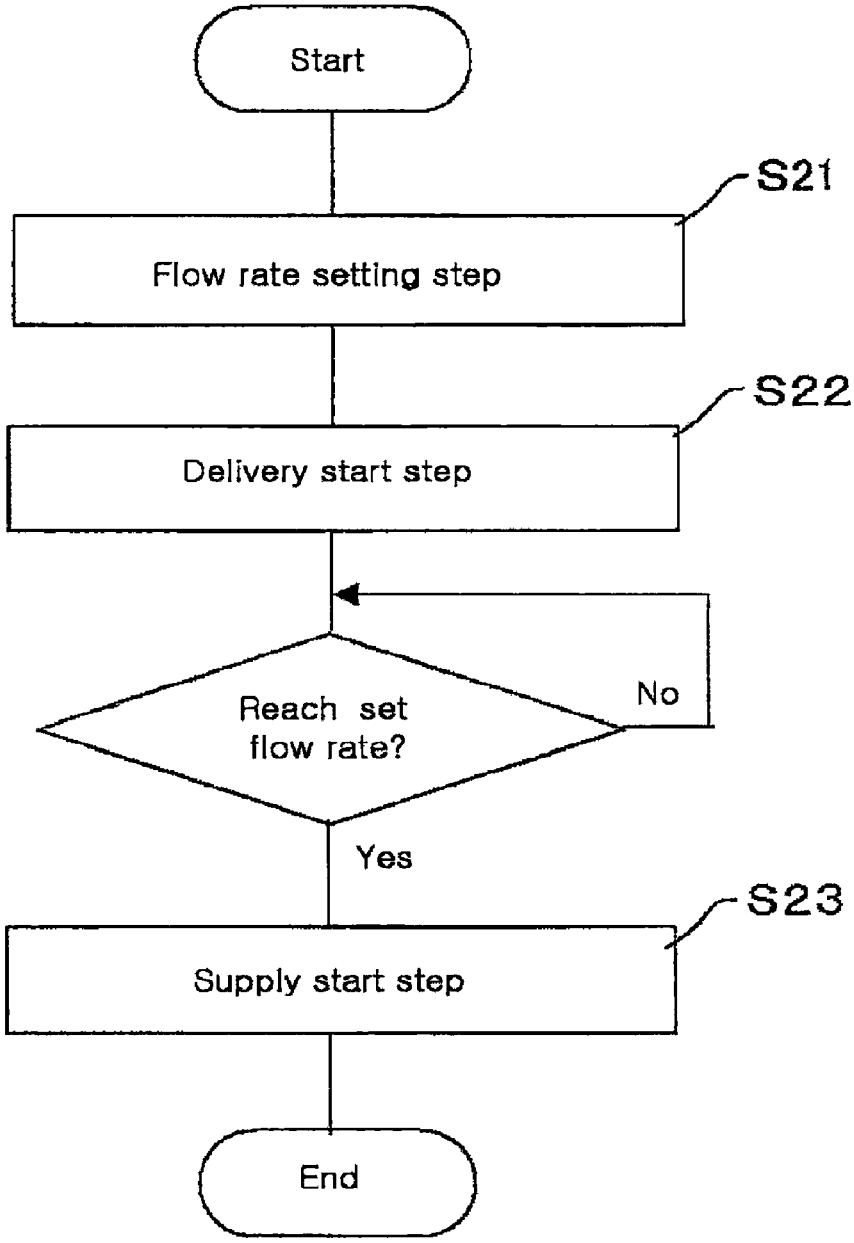
FIG. 3 is a flowchart illustrating a detailed manipulation sequence of each valve in producing step of processing liquid in a second mixing tank (S2) according to an embodiment of the present invention.
Figure 4:
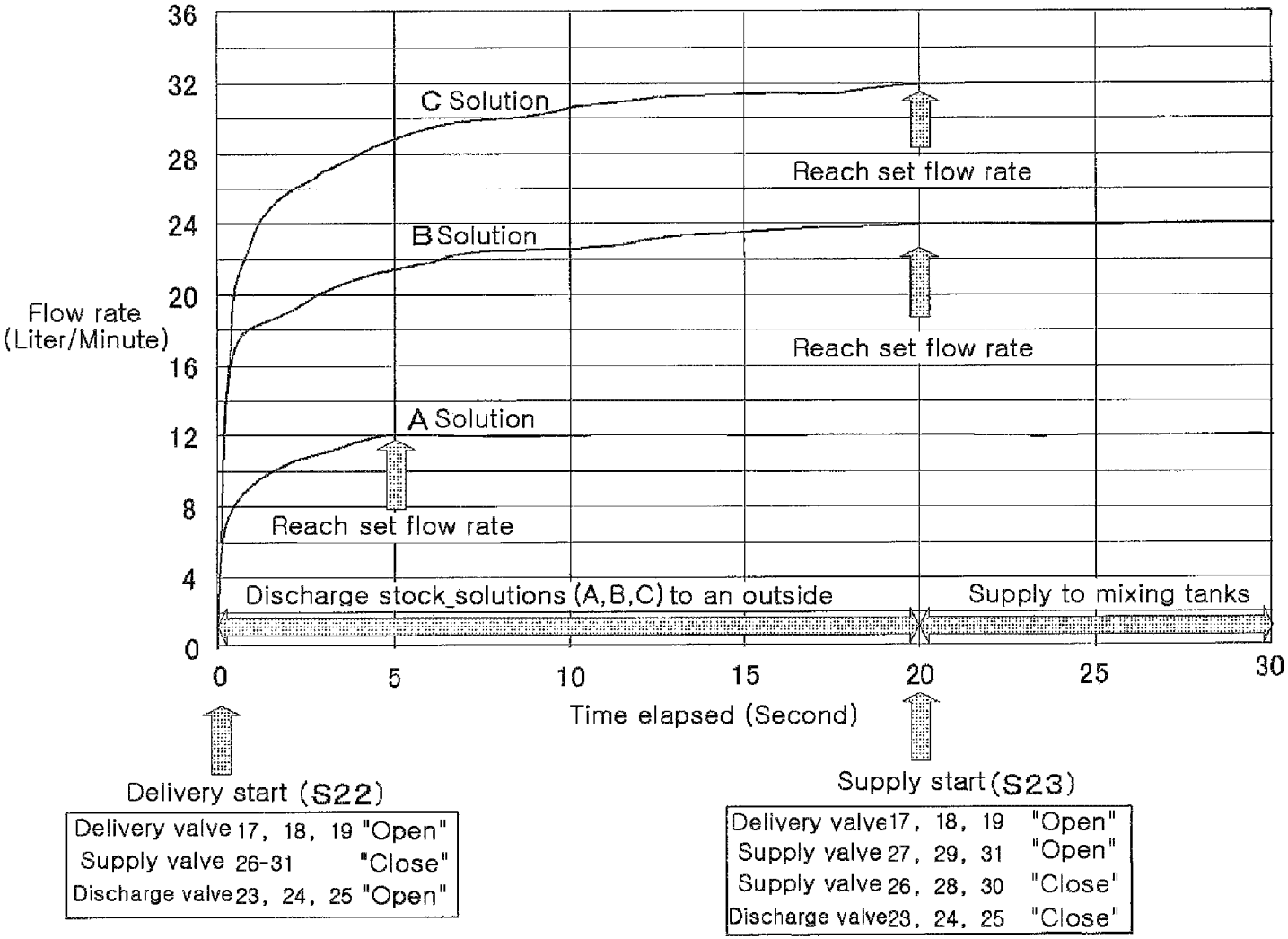
FIG. 4 is a timing diagram showing relations between the flow rate change of stock solutions A, B, and C with times and the manipulation timing of each valve in producing step of processing liquid in a second mixing tank (S2) according to an embodiment of the present invention.

FIG. 3 is a flowchart illustrating a detailed manipulation sequence of each valve in producing step of processing liquid in a second mixing tank (S2) according to an embodiment of the present invention. FIG. 4 is a timing diagram showing relations between the flow rate change of stock solutions A, B, and C with times and the manipulation timing of each valves in producing step of processing liquid in a second mixing tank (S2) according to an embodiment of the present invention. Hereinafter, with reference to FIGS. 3 and 4, the detailed manipulation sequence of the respective valves will be described.

[Flow Rate Setting Step (S21)]

The control unit 32 sets the LFC 20, 21, and 22 such that the LFC 20, 21, 22 deliver the stock solutions A, B, and C in the ratio of 12:24:32 liters per minute, respectively. This flow rate setting step needs not to be executed every time when continuously operating the substrate processing apparatus 1 with the same set flow rate.

[Delivery Start Step (S22)]

Then, the control unit 32 opens the discharge valves 23, 24, and 25. At this time, since the supply valves 27 to 31 are in a closed state, the stock solutions A, B, and C delivered from the delivery valves 17, 18, and 19 are discharged to an outside through the discharge valves 23, 24, and 25.

Also, if the discharge valves 23, 24, and 25 are open, the flow rates of the stock solutions A, B, and C flowing through the A, B, and C solution supply flow paths 14, 15, and 16 via the LFC 20, 21, and 22 gradually increase and reach the set flow rate.

[Supply Start Step (S23)]

If all the flow rates of the stock solutions in the A, B, and C solution supply flow paths 14, 15, and 16, being detected by the LFC 20, 21, and 22, reach the set flow rate, the control unit 32 closes the discharge valves 23, 24, and 25, and simultaneously opens the supply valves 27, 29, and 31 to supply the stock solutions A, B, and C to the second mixing tank 3.

As described above, since the substrate processing apparatus 1 supplies the stock solutions A, B, and C from the A, B, and C solution supply flow paths 14, 15, and 16 to the second mixing tank 3 after the flow rate of each of the stock solutions A, B, and C in the A, B, and C solution supply flow paths 14, 15, and 16 reaches the set flow rate, the second mixing tank 3 can produce the processing liquid of a predetermined mixing ratio (i.e. density) just after the supply starts. Accordingly, the mixing ratio (i.e. density) of the processing liquid in the second mixing tank becomes uniform in a short time, and thus the supply of the processing liquid to the chemical solution processing units 12 and 13 can immediately start.

However, in the above-described delivery start step (S22), the discharge valves 23, 24, and 25 are simultaneously open. On the other hand, the time required for the flow rates to reach the predetermined flow rate from the start of delivery of the LFC 20, 21, and 22 is lengthened as the set flow rate increases. For example, as described above, the time required for the flow rate of the stock solution A, being delivered through the LFC 20, to reach 12 liters per minute and to be stabilized is 5 seconds after the delivery valve 17 is open. By contrast, the time required for the flow rate of the stock solution B, being delivered through the LFC 21, to reach 24 liters per minute and to be stabilized and the time required for the flow rate of the stock solution C, being delivered through the LFC 22, to reach 32 liters per minute and to be stabilized are all about 20 seconds. Accordingly, the stock solution A should be continuously discharged to an outside by opening the discharge valve 23 in the A solution supply flow path 14 until the flow rates of the stock solutions B and C reach the predetermined flow rate even after the flow rate of the stock solution A reaches the predetermined flow rate (e.g. 12 liters per minute).

Accordingly, if the delivery valves 17, 18, and 19 are open with time differences according to the set flow rates of the LFC 20, 21, and 22 and the time-flow rate characteristics so that the flow rates of the stock solutions A, B, and C simultaneously reach the predetermined flow rate, the amount of the stock solution A being discharged to an outside can be reduced.

Figure 5:
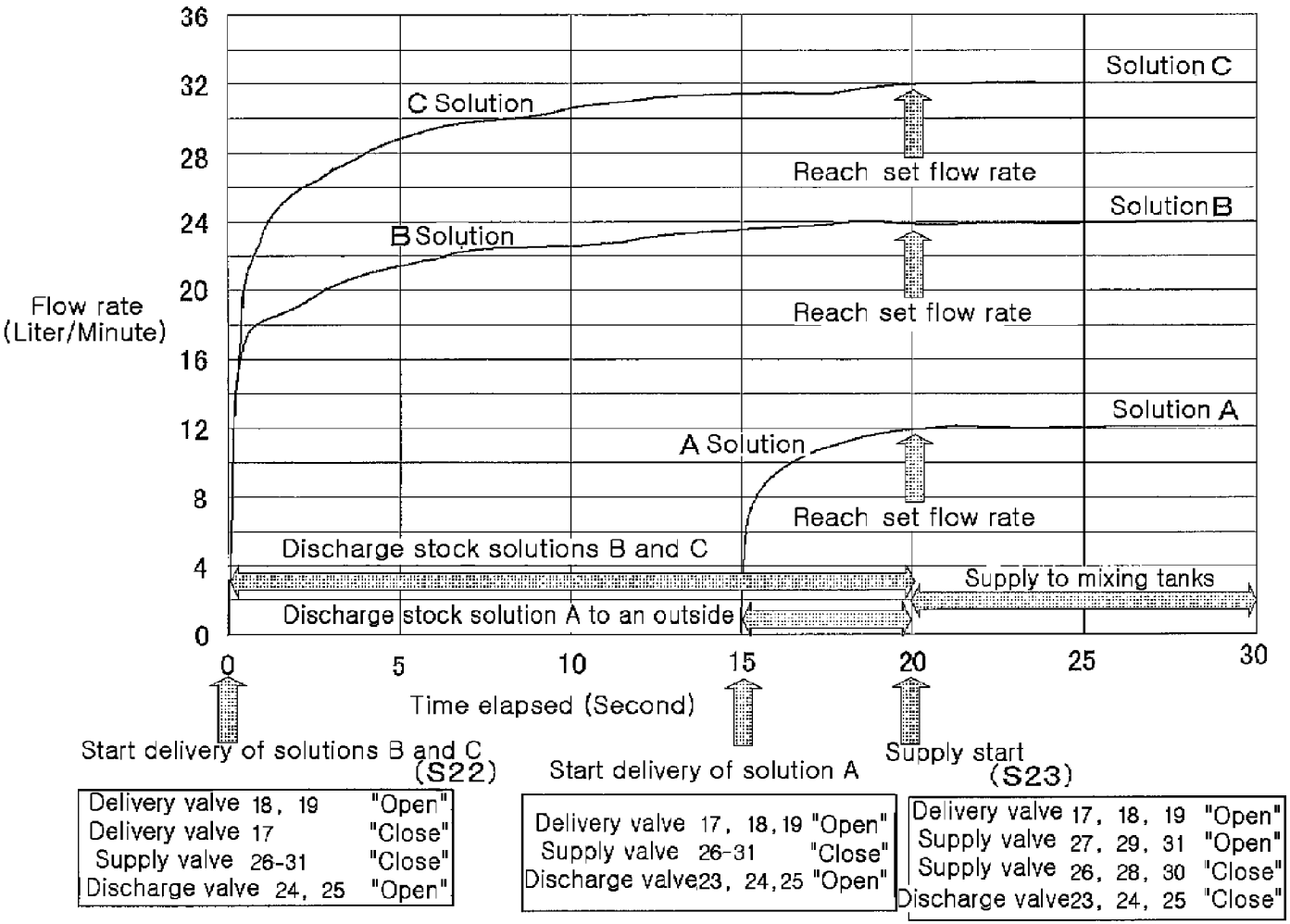
FIG. 5 is a timing diagram showing improved examples of the manipulation timing of respective valves in producing step of processing liquid in a second mixing tank (S2) according to an embodiment of the present invention.

For example, as illustrated in FIG. 5, if the delivery of the stock solutions B and C starts by opening the delivery valves 18 and 19 and the discharge valves 24 and 25 and then the delivery of the stock solution A starts by opening the delivery valve 17 and the discharge valve 23 after 15 seconds, the flow rates of the stock solutions A, B, and C reach the set flow rate almost simultaneously after about 20 seconds from the opening of the discharge valves 24 and 25. Thus, the supply of the stock solutions A, B, and C to the second mixing tank 3 can start. Accordingly, the discharge time of the stock solution A is shortened in comparison to the manipulation sequence as illustrated in FIG. 4, and thus a loss of the stock solution A can be reduced.

Although it is exemplified that the supply of the stock solutions A, B, and C to the mixing tanks starts when all the flow rates of the stock solutions A, B, and C reach the set flow rate, the supply of the stock solutions to the mixing tanks may start when a predetermined time elapses after all the flow rates of the stock solutions A, B, and C reach the set flow rate. In this case, the flow rates of the stock solutions A, B, and C are further stabilized, and thus the uniformity of the mixing ratio (i.e. density) of the processing liquid is further improved.

In the embodiments of the present invention, it is exemplified that two mixing tanks are provided and alternately used to produce processing liquid. However, the present invention can be applied to the substrate processing apparatus provided with only one mixing tank.

Also, according to the processing liquid mixing apparatus of the present invention, since the mixed processing liquid is uniformed in a short time, the processing liquid can be supplied to the chemical solution processing units in a short time after the supply of the stock solutions is completed. Also, the processing liquid can be supplied from the mixing tank to the chemical solution processing units simultaneously with the supply of the stock solutions to the mixing tank. Accordingly, even if only one mixing tank is provided or either of two mixing tanks is out of order, the interruption time of the chemical solution process can be minimized, or the chemical solution processing apparatus can operate without being suspended.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A processing liquid mixing apparatus, comprising:

a mixing tank to mix a plurality of stock solutions;

a flow controller provided in supply flow paths to control flow rates of the stock solutions flowing through the supply flow paths at predetermined flow rates, the supply flow paths each supplying the stock solutions from stock solution supply sources to the mixing tank;

a flow detector to detect the flow rates of the stock solutions flowing through the supply flow paths;

discharge valves provided between the flow controller of the supply flow paths and the mixing tank to discharge the stock solutions flowing through the supply flow paths to an outside;

supply valves provided between the discharge valves of the supply flow paths and the mixing tank to open/close the supply flow paths; and a controller to close the supply valves of the supply flow paths and to open the discharge valves of the supply flow paths when the supply of the stock solutions to the mixing tank starts, and to close the discharge valves of the supply flow paths and to open the supply valves of the supply flow paths after all the flow rates of the stock solutions detected by the flow detector reach the predetermined flow rates.

2. The apparatus of claim 1, wherein the controller closes the discharge valves and opens the supply valves when all the flow rates detected by the flow detector reach the predetermined flow rates and a predetermined time elapses.

3. The apparatus of claim 1, wherein the controller opens the discharge valves for each stock solution with time differences according to the set flow rates of the flow controller and time-flow rate characteristic.

4. The apparatus of claim 3, wherein the controller opens the discharge valves in the descending order of the set flow rates of the flow controller.

5. A substrate processing apparatus, comprising a processing liquid mixing apparatus, the processing liquid mixing apparatus comprising:

a mixing tank to mix a plurality of stock solutions;

a flow controller provided in supply flow paths to control flow rates of the stock solutions flowing through the supply flow paths at predetermined flow rates, the supply flow paths each supplying the stock solutions from stock solution supply sources to the mixing tank;

a flow detector to detect the flow rates of the stock solutions flowing through the supply flow paths;

discharge valves provided between the flow controller of the supply flow paths and the mixing tank to discharge the stock solutions flowing through the supply flow paths to an outside;

supply valves provided between the discharge valves of the supply flow paths and the mixing tank to open/close the supply flow paths; and a controller to close the supply valves of the supply flow paths and to open the discharge valves of the supply flow paths when the supply of the stock solutions to the mixing tank starts, and to close the discharge valves of the supply flow paths and to open the supply valves of the supply flow paths after all the flow rates of the stock solutions detected by the flow detector reach the predetermined flow rates.

6. The apparatus of claim 5, wherein the controller closes the discharge valves and opens the supply valves when all the flow rates detected by the flow detector reach the predetermined flow rates and a predetermined time elapses.

7. The apparatus of claim 5, wherein the controller opens the discharge valves for each stock solution with time differences according to the set flow rates of the flow controller and time-flow rate characteristic.

8. The apparatus of claim 7, wherein the controller opens the discharge valves in the descending order of the set flow rates of the flow controller.

9. A method for mixing processing liquid using a processing liquid mixing apparatus, the processing liquid mixing apparatus comprising a mixing tank to mix a plurality of stock solutions; a flow controller provided in supply flow paths to control flow rates of the stock solutions flowing through the supply flow paths at predetermined flow rates, the supply flow paths each supplying the stock solutions from stock solution supply sources to the mixing tank; a flow detector to detect the flow rates of the stock solutions flowing through the supply flow paths; discharge valves provided between the flow controller of the supply flow paths and the mixing tank to discharge the stock solutions flowing through the supply flow paths to an outside; and supply valves provided between the discharge valves of the supply flow paths and the mixing tank to open/close the supply flow paths, the method comprising:

closing the supply valves of the supply flow paths and opening the discharge valves of the supply flow paths when the supply of the stock solutions to the mixing tank starts; and closing the discharge valves of the supply flow paths and opening the supply valves of the supply flow paths after all the flow rates of the stock solutions detected by the flow detector reach the predetermined flow rates.

10. The method of claim 9, further comprising closing the discharge valves and opening the supply valves when all the flow rates detected by the flow detector reach the predetermined flow rates and a predetermined time elapses.

11. The method of claim 9, further comprising opening the discharge valves for each stock solution with time differences according to the set flow rates of the flow controller and a time-flow rate characteristic.

12. The method of claim 11, further comprising opening the discharge valves in the descending order of the set flow rates of the flow controller.

13. A storage medium storing a program executed by a computer that controls a processing liquid mixing apparatus, the processing liquid mixing apparatus comprising a mixing tank to mix a plurality of stock solutions; a flow controller provided in supply flow paths to control flow rates of the stock solutions flowing through the supply flow paths at predetermined flow rates, the supply flow paths each supplying the stock solutions from stock solution supply sources to the mixing tank; a flow detector to detect the flow rates of the stock solutions flowing through the supply flow paths; discharge valves provided between the flow controller of the supply flow paths and the mixing tanks to discharge the stock solutions flowing through the supply flow paths to an outside; and supply valves provided between the discharge valves of the supply flow paths and the mixing tank to open/close the supply flow paths;

wherein the program includes:

closing the supply valves of the supply flow paths and opening the discharge valves of the supply flow paths when the supply of the stock solutions to the mixing tank starts; and closing the discharge valves of the supply flow paths and opening the supply valves of the supply flow paths after all the flow rates of the stock solutions detected by the flow detector reach the predetermined flow rates.

* * * * *